US007846028B2

(12) United States Patent
Small et al.

(10) Patent No.: US 7,846,028 B2
(45) Date of Patent: Dec. 7, 2010

(54) LAZER TAG ADVANCED

(75) Inventors: David B. Small, San Jose, CA (US); Brian D. Farley, Dublin, CA (US); Wayne R. Park, Providence, RI (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 1018 days.

(21) Appl. No.: 11/436,399

(22) Filed: May 18, 2006

(65) Prior Publication Data

US 2006/0287113 A1 Dec. 21, 2006

Related U.S. Application Data

(60) Provisional application No. 60/682,441, filed on May 19, 2005.

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/51; 463/36; 463/39; 463/49; 463/53; 463/56

(58) Field of Classification Search ..... 463/36, 463/39, 49, 51, 53, 56

See application file for complete search history.

(56) References Cited

U.S. PATENT DOCUMENTS

| | | | |
|---|---|---|---|
| 2,100,348 | A | 11/1937 | Nicolson |
| 2,404,653 | A | 7/1946 | Plebanek |
| 2,494,645 | A | 1/1950 | Collins |
| 2,957,693 | A | 10/1960 | Ross |
| 2,990,471 | A | 6/1961 | Tiffany |
| 3,202,425 | A | 8/1965 | Van Hennik |
| 3,220,732 | A | 11/1965 | Pincus |
| 3,277,303 | A | 10/1966 | Jensen et al. |
| 3,434,226 | A | 3/1969 | Schaller |
| 3,499,650 | A | 3/1970 | Lemelson |
| 3,508,751 | A | 4/1970 | Meyer et al. |
| 3,549,147 | A | 12/1970 | Katter |
| 3,705,986 | A | 12/1972 | Sanders et al. |
| 3,789,136 | A | 1/1974 | Haith et al. |

(Continued)

FOREIGN PATENT DOCUMENTS

| | | |
|---|---|---|
| GB | 2153498 | 8/1995 |

(Continued)

*Primary Examiner*—John M Hotaling, II
*Assistant Examiner*—Adetokunbo Torimiro
(74) *Attorney, Agent, or Firm*—Blakely Sokoloff Taylor & Zafman LLP

(57) ABSTRACT

Interactive methods and apparatus for infrared (IR) shooting games between participants are disclosed. The infrared transmitting and receiving toy has an interface display, switches, and an IR device for transmitting and receiving first or second data between participants, including tag or hit information and special attack information in response to user actuation of one or more inputs. The information processor generates a hit or tag tally upon receiving first data from IR receiver, and generates an activity upon receiving second data including a video-game or puzzle style activity on the interface display. In a further embodiment, the information processor is capable of storing gameplay experience, and the information processor may alter gameplay capabilities based on the accumulated gameplay experience of many games.

26 Claims, 4 Drawing Sheets

U.S. PATENT DOCUMENTS 3,870,305 A 3/1975 Harclerode
3,898,747 A 8/1975 Marshall
3,927,316 A 12/1975 Citta
3,960,380 A 6/1976 Yokoi
3,995,376 A 12/1976 Kimble et al.
4,008,478 A 2/1977 Ikrath et al.
4,056,719 A 11/1977 Waaben
4,151,407 A 4/1979 McBride et al.
4,164,081 A 8/1979 Berke
4,171,811 A 10/1979 Meyer et al.
4,249,265 A 2/1981 Coester
4,266,776 A 5/1981 Goldfarb
4,267,606 A 5/1981 Stelter et al.
4,352,665 A 10/1982 Kimble et al.
4,375,106 A 2/1983 Voll
4,426,662 A 1/1984 Skerlos et al.
4,456,793 A 6/1984 Baker et al.
4,533,144 A 8/1985 Juarez et al.
4,545,583 A 10/1985 Pearman et al.
4,586,715 A 5/1986 Scolari et al.
4,603,975 A 8/1986 Cinzori
D286,308 S 10/1986 Mayer et al.
4,629,427 A 12/1986 Gallagher
4,648,131 A 3/1987 Kawaguchi et al.
4,689,827 A 8/1987 Gurney, Jr.
4,695,058 A * 9/1987 Carter et al. ..... 463/5
4,709,411 A 11/1987 Mori
4,717,913 A 1/1988 Elger
4,754,133 A 6/1988 Bleich
4,772,028 A 9/1988 Rockhold et al.
4,781,593 A 11/1988 Birge et al.
4,802,675 A 2/1989 Wong et al.
4,807,031 A 2/1989 Broughton et al.
4,808,143 A 2/1989 Kuo
4,823,401 A 4/1989 Gammarino et al.
4,844,475 A 7/1989 Saffer et al.
D303,130 S 8/1989 Noble
4,898,391 A 2/1990 Kelly et al.
RE33,229 E 6/1990 Schwaber
D308,400 S 6/1990 Ferri
4,931,028 A 6/1990 Jaeger et al.
4,936,037 A 6/1990 Holcomb et al.
4,938,483 A 7/1990 Yavetz
4,959,827 A 9/1990 Grotzinger et al.
4,996,787 A 3/1991 Holcomb et al.
D316,123 S 4/1991 Shiung-Fei
5,029,872 A 7/1991 Sassak
5,044,107 A 9/1991 Holford
5,253,068 A 10/1993 Crook et al.
5,288,078 A 2/1994 Capper et al.
5,319,190 A 6/1994 Allen et al.
5,320,362 A 6/1994 Bear et al.
5,354,057 A 10/1994 Pruitt et al.
5,359,446 A 10/1994 Johnson et al.
5,369,432 A 11/1994 Kennedy
5,375,847 A 12/1994 Fromm et al.
5,401,025 A 3/1995 Smith, III et al.
5,426,295 A 6/1995 Parikh et al.
5,437,463 A 8/1995 Fromm
5,455,702 A 10/1995 Reed et al.
5,495,357 A 2/1996 Osterhout
5,528,264 A 6/1996 Kautzer et al.
5,552,917 A 9/1996 Darbee et al.
5,571,018 A 11/1996 FitzGerald
5,577,962 A 11/1996 Kounoe et al.
5,648,862 A 7/1997 Owen
5,656,907 A 8/1997 Chainani et al.
5,672,108 A 9/1997 Lam et al.
5,721,783 A 2/1998 Anderson
5,741,185 A 4/1998 Kwan et al.
5,742,251 A 4/1998 Gerber
5,763,900 A 6/1998 Wang
5,785,592 A 7/1998 Jacobsen
5,788,500 A 8/1998 Gerber
5,802,467 A 9/1998 Salazar et al.
5,835,862 A 11/1998 Nykanen et al.
5,904,621 A 5/1999 Small et al.
5,914,661 A 6/1999 Gross
5,966,226 A 10/1999 Gerber
5,971,855 A 10/1999 Ng
5,984,788 A 11/1999 Lebensfeld et al.
5,995,592 A 11/1999 Shirai et al.
D433,074 S 10/2000 Clemmer
6,154,663 A 11/2000 Itamochi
6,174,169 B1 1/2001 Gerber
6,248,019 B1 6/2001 Mudie et al.
6,261,180 B1 7/2001 Lebensfeld et al.
6,270,409 B1 8/2001 Shuster
6,278,378 B1 8/2001 Feiner et al.
6,281,811 B1 8/2001 Ranzino
6,285,476 B1 9/2001 Carlson et al.
6,293,869 B1 9/2001 Kwan et al.
6,302,796 B1 10/2001 Lebensfeld et al.
6,311,209 B1 * 10/2001 Olson et al. ..... 709/204
6,314,401 B1 11/2001 Abbe et al.
6,398,555 B1 6/2002 Gerber et al.
6,450,816 B1 9/2002 Gerber
6,524,189 B1 2/2003 Rautila
6,569,011 B1 5/2003 Lynch et al.
6,579,097 B1 6/2003 Sampson et al.
6,638,070 B1 10/2003 Healy et al.
6,814,667 B2 11/2004 Jeffway, Jr. et al.
6,893,346 B2 5/2005 Small et al.
7,306,523 B1 12/2007 Jeffway, Jr. et al.
7,338,375 B1 3/2008 Small
7,632,187 B1 12/2009 Farley et al.
2002/0070881 A1 6/2002 Marcarelli et al.
2002/0082065 A1 6/2002 Fogel et al.
2002/0111201 A1 8/2002 Lang
2002/0198055 A1 12/2002 Bull et al.
2003/0027103 A1 2/2003 Preston et al.
2003/0027640 A1 * 2/2003 Jeffway et al. ..... 463/49
2003/0125112 A1 * 7/2003 Silvester ..... 463/42
2003/0153387 A1 8/2003 Small et al.
2003/0186744 A1 10/2003 Bradell
2003/0199319 A1 10/2003 Culbert
2004/0029079 A1 2/2004 Healey et al.
2004/0029080 A1 2/2004 Healey et al.
2005/0043102 A1 2/2005 Anderson et al.

FOREIGN PATENT DOCUMENTS

JP 2004-024584 1/2004

* cited by examiner

LAZER TAG ADVANCED

CROSS-REFERENCE TO RELATED APPLICATION

This application claims priority pursuant to 35 USC 119(e) to U.S. Provisional Application No. 60/682,441, filed on May 19, 2005, which is incorporated herein by reference in its entirety.

FIELD OF THE INVENTION

The present invention relates to infrared (IR) toy shooting games, and more particularly to IR gun and game device combination interactive systems in communication with one or more other shooting apparatus.

BACKGROUND OF THE INVENTION

Shooting game toys are generally known including shooting apparatus embodied as gun apparatus. IR electronic shooting games include communication devices for transmission and reception of IR light signals, operating on principles of IR remote control. IR shooting games typically include two channels of IR communication, namely, a channel for transmitting an IR signal (i.e., a tag or shot) and a channel for receiving the transmitted IR signals. Such IR electronic shooting games involve two or more players, each equipped with an apparatus for sending IR signals (e.g., a gun) and an apparatus for receiving IR signals (e.g., a target), wherein the object of the game is to target and shoot opponents with an IR signal, thereby scoring a "hit" or a "tag" until only one player or team remains in the game. Such infrared electronic shooting games are relatively well known and have been available since about 1979. For example, one infrared electronic shooting game sold beginning in about 1986 by WORLDS OF WONDER TM, permitted players to fire invisible beams at one another with each player being provided with a game unit for emission of an infrared light beam. In the WORLDS OF WONDER TM game, a target was affixed to each player in order to count the number of "hits" registered by the target associated with each player, and a player was tagged "out" when six hits were registered for that player. Other infrared electronic shooting games that are known include indoor arena games such as LASER QUEST TM and the like.

In view of the forgoing, traditional implementations of IR shooting game, the several described embodiments for a Lazer Tag Advanced (LTA) system in accordance with the present inventions facilitates novel Infrared Shooting Games (IRSG) systems as well as novel game play and environments for IRSG play. Traditionally, IRSG are simply shooting games. Prior advancements in the art were either electromechanical details such as improved receiver design or improvements in the method of defining a game or storing the results.

In at least a first described embodiment that LTA differs from previous IRSG systems is that it moves away from the pure shooting model. A large element of LTA play is outthinking your opponents rather than simply out-shooting them. In addition to the expected "tags" or "shots", there are also "special attacks" which can cause simulated damage, loss of resources or capabilities, or chaotic behavior of the opponent's "gun" (hereinafter referred to collectively with the rest of the apparatus as a "Tagger") if not properly countered by the successful completion of a short video game, logic puzzle, or code-breaking challenge. Further, players must weigh the option of diverting some of their game resources to the acquisition of "dismissals" for those types of special attacks against which they have the most trouble defending themselves.

In at least a second described embodiment in which LTA advances the art is that the capability of the Tagger itself to evolve as the user gains more experience. Prior IRSG systems kept track of who tagged who only long enough to score the game and perhaps print out the results. Each game was a self-contained entity which had no effect on any future games other than such artificial rules as the players themselves might choose to implement. But in LTA, the outcome of each game feeds into the cumulative total game experience of the Tagger and this in turn affects the capabilities of that Tagger for future games. New types of attacks and defenses become available to the user only as they prove they have mastered previous ones, and failure to master these new capabilities can result in the loss of their use.

In at least a third described embodiment in which LTA differs from traditional IRSG play is in the use of a short-range, wide-angle transmitter for local-area gaming as opposed to the long-range narrow-angle transmitter more normally associated with IRSG style gaming (called "Wide-Area Gaming"). This is of particular use in circumstances where playing with traditional "shooting game" style toys would not be possible or desirable. In playing the Local Area form of gaming, players are using the same special attacks which they could normally be "shooting" at each other in the wide-area gaming mode, but in this case they do not have to be carefully aimed and there is no physical running around needed In at least a fourth described embodiment in which LTA differs from traditional IRSG is that the special attacks carry with them specific information regarding the sending Tagger. This is particularly important when attempting to implement real-world forms of Fantasy Role-Playing games in which the Tagger represents a player's "character". In such games, it is not simply the attack itself but the experience "level" of the character launching the attack versus that of the character being attacked which determines how much damage the attack will do if successful. In LTA, this information is used in the scoring of the games (lower-level units gain more experience from defeating higher-level units than do higher-level units for defeating lower-level ones). However, this information could also be used to scale the damage done by such attacks or even to determine whether or not the attack would be registered at all, in accordance with defined game rules.

In at least a fifth described embodiment in which LTA differs from most prior IRSG systems is an extremely non-gun-like appearance. As previously mentioned, this is mainly for the purpose of making LTA's use more acceptable in places or circumstances where a "shooting toy" would not be appropriate. However, it is also envisioned that this will allow for the development of toys strongly themed to the Fantasy Role Playing market which the other LTA capabilities can exploit—for example, "magical" staffs for wizard duels.

SUMMARY OF THE INVENTION

The present invention relates to interactive methods and apparatus for infrared (IR) tag shooting games between participants. In a described embodiment, the information processor is responsive to hit or tag tally as being capable of storing gameplay experience, and the information processor may alter gameplay capabilities based on stored gameplay experience. Information processing is responsive to stored experience for determining a "Level" that defines operation of an IR device associated with the one or more other participants.

The apparatus includes a housing configured as an infrared transmitting and receiving toy has an interface display, user switches, and an IR device disposed within the housing for transmitting and receiving first or second data between participants.

An information processor is coupled to the interface and in communication with the IR device, with the first data including tag or hit information and the second data including special attack information. The information processor and IR transmitter are able to send first IR data indicative of one or more tags or shots being fired in response to user actuation of one or more inputs, and the information processor and IR transmitter are able to send second IR data indicative of a selected special attack in response to user actuation of one or more inputs. The information processor generates hit or tag tally upon receiving first data from IR receiver, and generates either an activity including a video-game or puzzle style activity on the interface display or a short duration modification to the functionality of the device upon receiving second data.

DETAILED DESCRIPTION OF THE PREFERRED EMBODIMENTS

Figure 1:
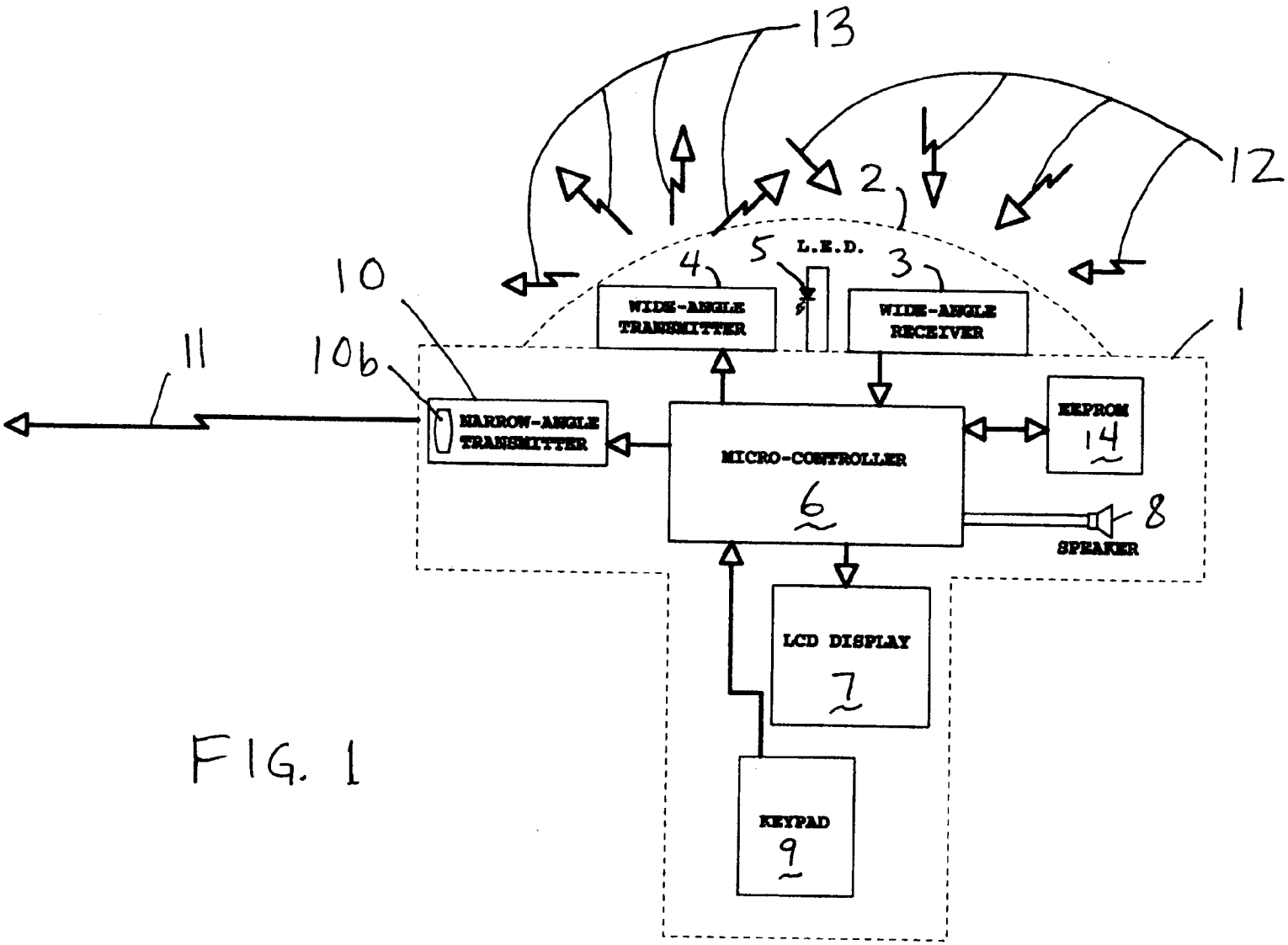
FIG. 1 is a schematic block diagram of an embodiment implementing a game architecture for an IR shooting apparatus in accordance with the present invention.

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention. Referring to FIG. 1 an interactive apparatus is shown for infrared (IR) tag shooting games between participants. The apparatus includes a housing configured as an infrared transmitting and receiving toy and has an interface display, switches, and an IR device disposed within the housing for transmitting and receiving first or second data between participants.

With reference to FIG. 1, the LTA "Taggers" each include a plastic housing 1 which has at its top a narrow dome-like window 2 for allowing IR radiation to pass into and out of the housing. Also located atop the housing and inside the window are the wide-angle receiver 3 and the wide-angle transmitter 4. In the existing design there is an LED indicator 5 located within the window as well, but this could just as easily be mounted elsewhere on the housing and could easily be more than one LED indicator for the purpose of indicating more than one noteworthy condition. The main body of the housing contains batteries (not shown), an information processor, herein micro-controller 6, an LCD display 7, a speaker 8, a keypad 9, and a narrow-angle transmitter 10 including a lens 10*b* for focusing the IR beam 11 into a narrow angle that will travel farther. The narrow-angle transmitter is disposed at the front of the housing in a manner similar to the barrel of a gun, such that the narrow-beam IR radiation 11 may be more accurately directed at distant opponents. It is normally used to send tags and special attacks during wide-area games.

The information processor 6 is coupled to the interface and in communication with the IR transmitters and receiver. The information processor and IR transmitter are able to send first IR data indicative of one or more tags or shots being fired in response to user actuation of one or more inputs, and the information processor and IR transmitter are able to send second IR data indicative of a selected special attack in response to user actuation of one or more inputs. The information processor generates hit or tag tally upon receiving first data from IR receiver, and generates either an activity including a video-game or puzzle style activity on the interface display or a short duration modification to the functionality of the device upon receiving second data. As discussed further herein, the information processor may be responsive to hit or tag tally and results of video game or puzzle solving activities as being capable of storing gameplay experience, and the information processor may alter gameplay capabilities based on stored gameplay experience. Information processing is responsive to the stored experience for determining a level that defines operation of the device associated with the one or more other participants.

As in most IRSG type games, the wide-angle receiver is positioned such that IR radiation 12 transmitted from other units can be received over a wide angle, preferably 360 degrees. This receiver is located on the Tagger housing in the existing system, but could also be body-worn (including as multiple receivers facing different directions) or head-worn.

The wide-angle transmitter is used to send IR 13 a short distance over a relatively wide pattern, so as to eliminate the need to carefully aim it and still be reasonably certain that it will be properly received on the wide-angle receiver of other units. This is used to communicate game set-up and scoring information before and after games respectively, and to send the special attacks in local-area games.

Although not strictly necessary to the invention, the device presently also contains a non-volatile memory or EEPROM 14 for the permanent storage of the accumulated experience, available attacks and defenses, and name(s) of the user(s). This is to prevent loss of this data when the batteries are replaced. There are alternative ways to accomplish this, such as either having the user enter a code to recreate the data once the batteries have been replaced, or having a set of small memory-back-up batteries to preserve RAM contents within the micro-controller while the main batteries are being changed.

Figure 2:
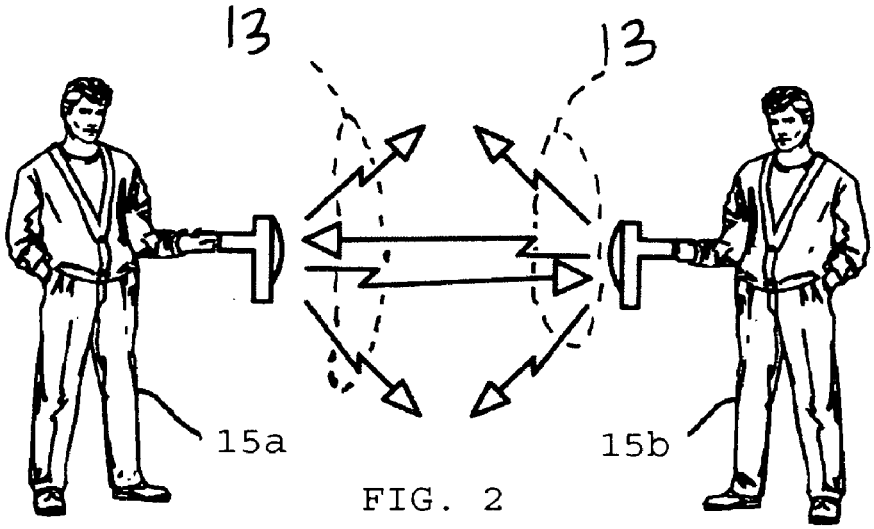
FIG. 2 illustrates a game configured such that the one player acts as a host and defines the game parameters; (side-note: this is also illustrates Local Area Gaming)

With reference to FIG. 2, a game is normally defined when one player 15*a* acts as a host and defines the game parameters on his Tagger. His Tagger then exchanges this game information with the Tagger operated by another user 15*b* via wide-angle IR broadcasts 13 from each Tagger's wide-angle transmitter to the wide-angle receiver of the other Tagger. When the second user's Tagger has been fully joined to the game, the process may be optionally repeated for such additional users as need be joined to the game.

This method of communicating wide-angle-transmitter to wide-angle-receiver is also used throughout the entire local-area form of play so that the players do not have to carefully aim their IR beams at one another. It is further used at the end of each game for the various players to exchange scoring information by simply coming close to one another and allowing the Taggers to exchange IR signals without the need to maintain precise alignment of the multiple Taggers.

Figure 3:
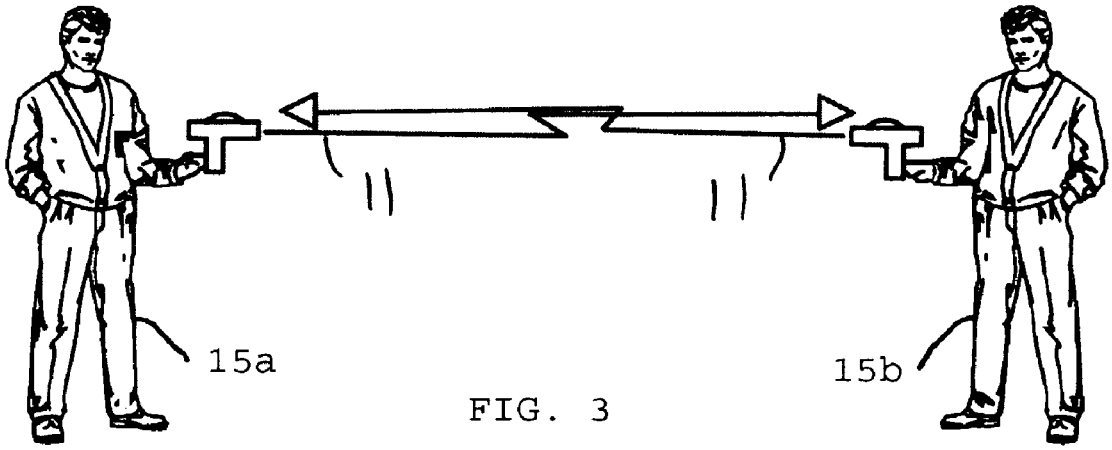
FIG. 3 illustrates game play of a wide-area game, in which tags and attacks are sent between players using the narrow-angle long-range IR beams in accordance with the present invention.

With reference to FIG. 3, during the actual play of a wide-area game, tags and attacks are sent from one player 15*a* to another player 15*b* and vice versa using the narrow-angle long-range IR beams 11. These beams travel to a considerably greater distance than the wide-angle beams do, but must be aimed much more carefully in order to register on the other player's wide-angle receiver.

Figure 4A:
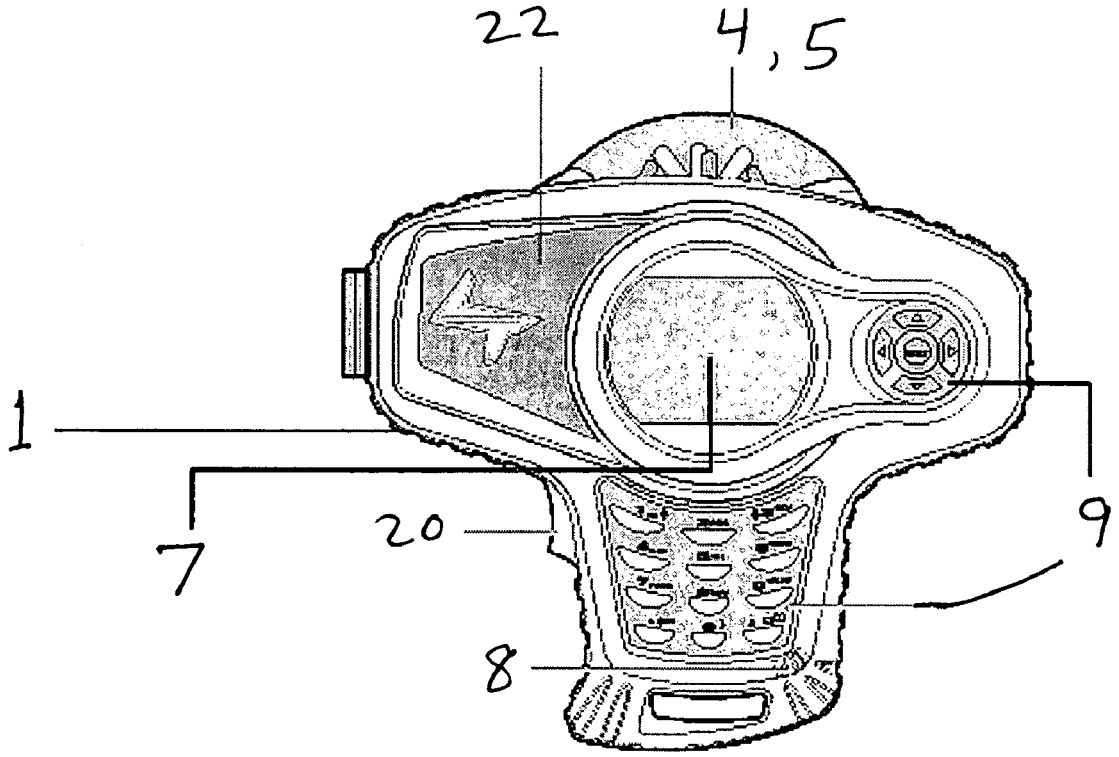
FIGS. 4A and 4B show a Tagger housing with reference to its display and icons in FIG. 4B signifying the countermeasures that can be earned to combat the example attacks in accordance with the present invention.
Figure 4B:
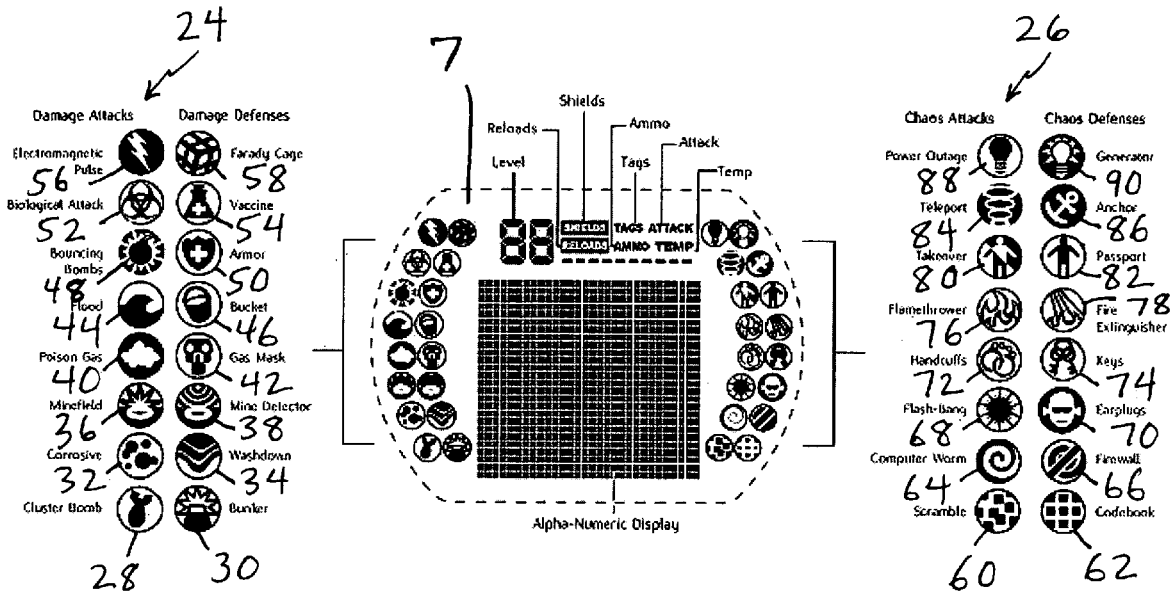

FIGS. 4A and 4B show the Tagger housing 1 with reference to its display 7 and icons in FIG. 4B signifying the capabilities that can be earned, as discussed further below. The Tagger 1 also includes a trigger 20 and swivel keypad cover 22.

Gaining Experience Points and Levels:

The three modes of play (Practice, Local-Area Gaming, and Wide-Area Gaming) accrue experience points for the user in different ways. The Practice mode allows users to accumulate experience slowly as they practice learning the names of the different attacks, which types of attacks are dismissed by which types of defenses, and how to win the video games associated with each different type of attack. Users cannot lose experience points in this mode. Practice mode however can only take a user up to Level 3 (of 8), beyond which experience points gained in this mode are no longer added to the player's cumulative total.

The Local-Area Gaming mode allows users to more rapidly gain experience points by engaging in one-on-one competitions against other human players. Players learn which attacks and defenses their opponents have and favor for use. Players also get a chance to "try out" the various attacks and defenses of the next level up, so that they will have some idea which of the options they will chose when they advance to that level. Experience points are gained more rapidly than in Practice Mode. Defeats in Local-Area Gaming mode do not cause a loss of experience points. Local-Area Gaming mode however can still only take a user up to Level 6, beyond which experience points gained in this mode are no longer added to the player's cumulative total.

Wide-Area Gaming mode pits multiple players against one another simultaneously, using only those special Attacks and Countermeasures which they have earned by advancing in Level. This mode can very rapidly gain experience points for a user, and these points are good for advancing the user's Level all the way up to the maximum of Level 8. However, significant defeats in this mode will cost the user experience points, potentially resulting in demotion to a lower Level.

In accordance with the present preferred embodiment, Tag games are described in a Role-Playing Game context. To this end, the underlying game play is about building up a "Character" and gaining capabilities for that Character even as the Player gains real-world experience of playing the game. A cumulative total of "Experience Points" is maintained, which changes based on the player's performance. As the Experience Points increase above predefined thresholds, the character increases in "Level." The Experience Points are invisible to the user (they are purely internal), while Level is visible to the user.

The Levels are not evenly spaced in Experience Points, so that the initial two or three Levels are advanced through quickly, but the final Levels take a tremendous amount of play time with good success to achieve. The longer and more intensely the user plays Lazer Tag Advanced, the sooner his Character will be able to advance in Level. Each new Level achieved allows the Player to select new Attacks and Countermeasures that his Character will be able to use—there are two Attacks and two Countermeasures associated with each Level, but the Player must choose only two total for his Character to use when he advances to that Level. He may choose both of the Attacks, or both of the Countermeasures, or either one of each. The two selected abilities then become available for his Character to use in future games for as long as he remains at or above the new Level. The remaining un-chosen items are no longer available. In this way, the Character is shaped by the cumulative set of decisions made as the Player brings his Character up through the Levels and this shaping has an impact on future play.

It is possible, through poor performance in the real-world tagging game, to lose Experience Points and thus potentially decrease in Level. If this happens, the abilities selected when the character increased in Level are lost, and in order to regain them (or select new abilities), the player must advance his character back up into the higher Level again.

User Interface and Design Features:

The user interface includes an LCD screen, a 12-button telephone style keypad, an Up-Down-Left-Right (UDLR) keypad, an ENTER button, a TRIGGER, and a rotating or detachable cover to prevent accidental pressing of buttons.

Most game play options and actions are performed using the UDLR keypad, the ENTER button, and the FIRE trigger. The telephone style keypad is only used to enter text messages or personalization information or to enter values when "purchasing" capabilities for use in a game. Text messaging is performed using a 9-key entry style.

Along the top of the Tagger is a receiver "dome" including two 45-degree IR-LED's (one forward and one aft). The dome also houses a set of 3 IR photodiodes, arranged so that the receiver can receive in a 360-degree horizontal by roughly 60-degree vertical pattern when the Tagger is held vertically. In addition, the dome houses a visible LED which blinks under processor control to indicate the receipt of data. The two IR-LED's are angled fore and aft by about 45 degrees each, so that there is effectively a 180-degree wide by 90-degree tall transmit pattern when the Tagger is laid flat on it's side—these IR-LED's will have a range of 10 to 20 feet depending on lighting conditions and are used for communications which are local in nature and do not need to be carefully aimed.

There is a third IR-LED located behind a lens in the "barrel" at the front of the Tagger. This IR-LED is used for transmitting tags and other information over a longer distance (75-125 feet depending on conditions) in a "tight beam" fashion so that it should only be received by the intended recipient Tagger and only if well aimed.

Attacks, Countermeasures, and Counter-Activities:

Users are trying to increase the Level of their Characters in order to acquire and use the special Attacks and their Countermeasures. Each of the Attacks has a corresponding Countermeasure which will completely foil the Attack.

Attacks are divided into two categories, DAMAGE Attacks 24 and CHAOS Attacks 26. One of each type, along with it's specific Countermeasure, becomes available with each new Level a Character reaches. As the names suggest, DAMAGE Attacks 24 cause simulated damage to the attacked player's Tagger, while CHAOS Attacks 26 cause the attacked Player's Tagger to behave in strange and chaotic ways. Countermeasures are used to dismiss the corresponding Attacks without suffering the damage or chaotic effects. When any Attack is received by a Tagger which has the Countermeasure for that Attack, the Countermeasure causes the Attack to end immediately so that no DAMAGE or CHAOS occurs, but the Countermeasure is also consumed.

Every DAMAGE attack 24 also has a corresponding Counter-activity—a small video game or puzzle, which if played successfully will thwart the Attack. These video games or puzzles are related in theme to the specific type of Attack. No simulated harm comes to the attacked player's Tagger while the Player is performing the Counter-activity, they are simply pass-fail activities which if played successfully will completely thwart the Attack (just as the Countermeasure would have), or if not played successfully result in the Attack having full effect.

There are no Counter-activities for the CHAOS Attacks 26. If a player is the victim of a CHAOS Attack 26 and does not already have the specific Countermeasure, the CHAOS attack 26 performs its action upon the attacked Tagger.

DAMAGE attacks 24 do their damage immediately upon failure to thwart them. CHAOS attacks 26 all start immediately if not thwarted with the Countermeasure, and run for 60 seconds.

Defining Multi-Player Games:

In Local Area Gaming, one Player selects "Head To Head" mode and selects a match duration. This causes his Tagger to begin broadcasting a Challenge from the two 45-degree IR-LED's. Another Tagger in the immediate area receives this broadcast, and displays that the player has been Challenged, along with the duration of the Challenge match. If the challenged player "Accepts" the Challenge, his Tagger replies to the first Tagger with an acceptance message and the two Taggers begin a preparatory period prior to the match start.

Every minute that the Challenge match is scheduled to run is worth a fixed number of purchase points to each of the players. During the preparatory period, the players select which abilities they wish to purchase for use in the match, and they may purchase as many of every available Attack and Countermeasure as they desire and can afford. Attacks and Countermeasures may also be purchased at any later time in the game. There are no Tags, Shields, or Reloads in Local Area Game Challenges, it is purely an Attacks and Countermeasures/Counter-activities game. Scoring is based on remaining in the game until the scheduled end and successfully landing Attacks on your opponent while also successfully defending against the Attacks your opponent lands on you. If one player manages to "knock his opponent out" of the game, the remaining player receives double score and the "knocked-out" player receives zero.

If one Player's Character is "knocked out of" the Local-Area Game, that player is the loser and his Tagger broadcasts a packet indicating the fact, which when received by the other Tagger ends the match. The two Taggers then communicate and exchange the scores tallied in each for one another.

In Local-Area Games it is to a player's scoring advantage to prolong the match as much as possible through the use of CHAOS Attacks 26 and lower-Level DAMAGE Attacks 24, and then "finish off" his opponent just before the match time expires.

Wide Area Gaming mode is more like the traditional IRSG play, but with new twists. Instead of all players starting with equal capabilities in their Taggers, they start with equal basic abilities, but also have the option of bringing a number of Special Attacks and/or Countermeasures into the game based on their Character Level and the specific game definition. This mode is played in more traditional IRSG locations, such as parks, schoolyards, and neighborhoods. The outcome of these battles can greatly affect the number of Character Experience Points of the participating Players—this is also the only mode in which Characters can lose Experience points and possibly decrease in Level.

Wide Area Gaming is performed entirely in real-time, and the primary goal is to knock all of the other players "out of the game"—this is because the last player remaining in the game will receive significant bonus points for doing so. Players all receive some points for the amount of time they managed to stay in the game. In addition, each player is trying to successfully land Attacks and tags on the other players (both for the intrinsic point value of doing so as well as for the opportunity to knock the other player out of the game) and effectively defend themselves against such attacks from the other players in order to gain points. Players lose points for being successfully attacked during the game. This is the only mode in which there are Tags (each one of which reduces the tagged Character's Health by 1) and Shields (which deflect received Tags).

A Wide-Area Game is defined on one Tagger (the "Host") and started. This begins a period in which other Taggers (the "Joiners") are brought to the Host, communicate with it, and receive the game definition and a unique Player ID for use during the game. At the start of the actual game, a preparatory period begins on all Taggers during which players all make their initial "purchases" of special Attacks and Countermeasures for the game, and take up their initial starting positions. Players can "purchase" more Attacks and Countermeasures during the game if they have purchase points remaining. The Host defines the available purchase points per player in the game, and the players are free to purchase as many or as few of each Attack and Countermeasure available to their Character as they wish.

When the game ends, each Tagger is already holding the scores against itself—these are deducted from the total Experience Points immediately. But the credit for landing attacks and surviving in the game are dependant on "Debriefing", which is the process of communicating with each of the other Taggers in the game and getting the total of any scores against them (as well as giving them their scores). Thus, it is in each player's self-interest to debrief against every other player in the game, as they have nothing to lose and possibly many points to gain.

Display:

With reference to FIG. 4B, the Tagger housing with reference to its display icons of the LCD screen 7 are shown providing icons on the right side of the pixel area that signify the attack abilities that can be earned. The icons on the left will signify the countermeasures that can be earned to combat the attacks. The center area is the game play area. Each Icon (see displays below) represents either an attack or a countermeasure (Icons on the left are attacks and Icons on the right are the associated countermeasures). Referring to the Attacks and Countermeasures detail, there are eight levels and each level has two attacks and two Countermeasures. The Icons represent each attack or Countermeasure, in practice an available attack or countermeasure will have a lit Icon and if the attack or countermeasure is not available the Icon will not be lit.

Attack Level Examples:

The following is a representative list of Attacks and their effects, Countermeasures, and Counter-Activities as used in Wide-Area Games. In Local-Area games most function in a similar manner, but where the damage would be of no meaning within a Local-Area Game (for example, elimination of 50% of Shields when there are no Shields in a Local-Area Game) then the damage may be different than that listed.

Level 1 Attacks

DAMAGE Attack 24: Cluster Bomb 28 Bomb

Defense: Bunker 30

Damage: Reduces attacked player's Health, Reloads, and Shields by 5%.

Counter-Activity: Use L-R keypad to dodge random falling bomblets.

CHAOS Attack 26: Scramble 60

Defense: Codebook 62

Chaos: Scrambles meanings of buttons for 60 seconds.

Level 2 Attacks

DAMAGE Attack 24: Corrosive Spill 32

Defense: Washdown 34

Damage: Reduces attacked player's Shields by 25%.

Counter-Activity: Use UDLR keypad to run through a maze washing down 10 corrosive spills.

CHAOS Attack 26: Computer Worm 64

Defense: Firewall 66

Chaos: All tags and Attacks fired by Tagger for 60 seconds are ineffective.

Level 3 Attacks

DAMAGE Attack 24: Minefield 36

Defense: Mine Detector 38

Damage: Attacked player loses 10% of remaining Reloads, Shields, and Health.

Counter-Activity: Use UDLR keypad to move figure through a "minefield" which contains a mix of live and deactivated mines while sound effects and a visual aid indicate proximity to the nearest live mine without actually identifying it.

CHAOS Attack 26: Flash-Bang 68 (Black Hole)

Defense: Ear Plugs 70

Chaos: Attacked player has no audio for 60 seconds (they must watch their screen very closely in order to be made aware of any attacks or tags landed on them during this time)

Level 4 Attacks

DAMAGE Attack 24: Poison Gas 40

Defense: Mask 42

Damage: Reduces attacked player's Health by 20%

Counter-Activity: Use UDLR keypad to get out of a maze without touching a randomly-moving gas cloud which is also in the maze.

CHAOS Attack 26: Handcuffs 72

Defense: Keys 74

Chaos: Prevents attacked player from launching any special attacks or using any special defenses for 60 seconds.

Level 5 Attacks

DAMAGE Attack 24: Creeping Fungus (alternately, Flood 44)

Defense: Fungicide (or bailing bucket 46)

Damage: Causes all purchased Attacks and Countermeasures to be lost.

Counter-Activity: Game of creeping fungus (or water), player must use LR keypad to move a figure back and forth and ENTER to launch fungicide-filled sponges in order to keep the fungus (or water) from reaching character.

CHAOS Attack 26: Overheat (also called Flamethrower 76)

Defense: Fire Extinguisher 78

Chaos: No purchasing or firing of Tags or Attacks allowed for 60 seconds, but Countermeasures continue to work if additional Attacks received.

Level 6 Attacks

DAMAGE Attack 24: Bouncing Bombs 48

Defense: Armor 50

Damage: Attacked player loses 90% of Reloads, 50% of remaining purchase points, and all Shields Counter-Activity: Use UDLR keypad to dodge two bombs which are bouncing around in a closed room.

CHAOS Attack 26: Takeover 80 (i.e., Identity Theft)

Defense: Passport 82

Chaos: Causes attacked Tagger to use attacker's ID for 60 seconds. All successful tags or attacks by the "victim" are thus credited to the attacker, while all successful tags or attacks on the "victim" still count against the "victim."

Level 7 Attacks

DAMAGE Attack 24: Biological Attack 52

Defense: Vaccine 54

Damage: Immediately reduces health to 10% of pre-attack value (if this is less than 1, the attacked player is out immediately). The attacked player then slowly regains health points over 60 seconds to a maximum of 50% of the pre-attack value, unless he is knocked out of the game first. Thus, this attack severely weakens an opponent, but not necessarily permanently.

Counter-Activity: Use UDLR keypad to doge raindrops and puddles from a toxic cloud. Player may jump over fallen drops.

CHAOS Attack 26: Teleport 84

Defense: Anchor 86

Chaos: "Victim" is suspended from the game for 60 seconds.

Level 8 Attacks

DAMAGE Attack 24: EMP (Electro Magnetic Pulse) 56

Defense: Faraday Cage 58

Damage: Removes 50% of Health, 50% of all remaining purchase points, all Shields, all Reloads, and all purchased Attacks and Countermeasures.

Counter-Activity: Use UDLR keypad to move parts of a Faraday Cage into place before the collapsing EMP reaches you.

CHAOS Attack 26: Power Outage 88

Defense: Generator 90

Chaos: Renders victim helpless (no firing tags or Attacks, no using Countermeasures, and no using shields) for 60 seconds. Can still defend against DAMAGE Attacks 24 during this time by playing the video games.

From the foregoing description and examples, there has been provided features for improved IR-type gun systems and methods. While particular embodiments of the present invention have been shown and described, it will be obvious to those skilled in the art that changes and modifications may be made without departing from the invention in its broader aspects. Therefore, the aim is to cover all such changes and modifications as fall within the true spirit and scope of the invention. The matter set forth in the foregoing description is offered by way of illustration only and not as a limitation. The actual scope of the invention is intended to be defined by the appended claims when viewed in their proper perspective based on the prior art.

What is claimed is:

1. An interactive apparatus for an infrared (IR) shooting game between a participant and at least one other participant, each having one of said interactive apparatus, said interactive apparatus comprising:

a housing configured as an infrared transmitting and receiving toy;

an interface including a display and a multiplicity of switches on said housing;

an IR transmitter and IR receiver disposed within said housing for transmitting first or second IR data to the IR receiver in the interactive apparatus of the at least one other participant and receiving first or second IR data from the IR transmitter in the interactive apparatus of the at least one other participant, said first IR data comprising tag or hit information, said second IR data comprising special attack information;

an information processor coupled to said interface and in communication with said IR transmitter and IR receiver, the information processor also being coupled to a non-volatile memory for storing accumulated gameplay experience and outcomes over a multiplicity of games;

said information processor and IR transmitter being able to transmit first IR data indicative of one or more tags or shots being fired in response to user actuation of one or more inputs;

said information processor and IR transmitter being able to transmit second IR data indicative of a selected special attack in response to user actuation of one or more inputs;

said information processor generating a hit or tag tally upon receiving first IR data;

said information processor generating one or more of an activity comprising a video-game or puzzle activity on said interface upon receiving second IR data from said IR receiver;

wherein said information processor changes gameplay capability based on the stored accumulated gameplay experience.

2. The interactive apparatus of claim 1, wherein said information processor uses said stored gameplay experience to determine a level of gameplay for that interactive apparatus.

3. The interactive device of claim 2, wherein said information processor uses said determined level to enable the transmitting of additional second data structures representative of additional special attacks.

4. The interactive apparatus of claim 2, wherein said first or second IR data includes said level information.

5. The interactive apparatus of claim 4, wherein said information processor receives the level information from said first or second IR data for modifying the manner in which said information processor reacts to the received data.

6. The interactive apparatus of claim 1, wherein said IR transmitter comprises a long distance narrow angle transmitter for use in wide area games and a short distance wide angle transmitter for use in local area games.

7. The interactive apparatus of claim 1 wherein said information processor and interface may be used by a host participant to define game parameters which are then transmitted from a host interactive apparatus to the at least one other interactive apparatus at the beginning of a game, said game parameters including a representation of a totality of purchase points available to each participant for the purchasing of capabilities to be used during the game.

8. The interactive apparatus of claim 7 wherein the information processor and interface allow a participant to exchange some or all of the purchase points remaining from the exchange prior to the start of the game into desired attacks and defenses at any point during the game.

9. The interactive apparatus of claim 7 wherein the information processor and interface allow a participant to exchange some or all of the purchase points from the game definition into desired attacks and defenses prior to the start of the game.

10. An interactive apparatus for an infrared (IR) tag shooting game between a user-participant and at least one other participant, each other participant having one of said interactive apparatus, said interactive apparatus comprising:

a housing configured as an infrared transmitting and receiving toy;

an interface including a display and a multiplicity of switches on said housing;

an IR transmitter and IR receiver disposed within said housing for transmitting IR data to the IR receiver in the interactive apparatus of at least one other participant and receiving IR data from the IR transmitter in the interactive apparatus of at least one other participant;

an information processor coupled to said interface and in communication with said IR transmitter and IR receiver;

said information processor and IR transmitter being able to send IR data to an indicative apparatus of at least one other participant indicative of one or more tags or shots being fired in response to user actuation of one or more inputs;

said information processor and IR receiver being able to receive IR data transmitted from an interactive apparatus of at least one other participant indicative of one or more tags or shots having been properly aimed and fired at the receiving apparatus;

said information processor generating hit or tag tally upon receiving IR data from said IR receiver indicative of IR data transmitted by an IR transmitter in an active apparatus of at least one other participant;

said information processor being capable of storing gameplay experience;

said information processor altering gameplay capabilities of the interactive apparatus based on stored gameplay experience over a multiplicity of games.

11. The interactive apparatus of claim 10 wherein game parameters are transmitted from host interactive apparatus for receipt by each interactive apparatus at the beginning of a game.

12. The interactive apparatus of claim 10 wherein each interactive apparatus is configured to request game statistics from each other interactive apparatus at the end of the game.

13. The interactive apparatus of claim 10, wherein said information processor uses said stored gameplay experience to determine a level of gameplay for that interactive apparatus.

14. The interactive apparatus of claim 13, wherein said information processor enables additional capabilities based on the determined level.

15. The interactive apparatus of claim 13, wherein said transmitted IR data contains said level information.

16. The interactive apparatus of claim 15, wherein said information processor is configured to modify the manner in which the interactive apparatus acts responsive to level information contained in the received IR data.

17. An interactive infrared (IR) shooting game method between a participant and one or more other participants, the method comprising:

providing each participant with a user interface including a display on a housing configured as a shooting toy;

transmitting a special attack to the one or more other participants;

generating a video game or puzzle activity on the user interface in response to receipt of a special attack:

information processing responsive to user input for determination of a video game outcome;

storing accumulated gameplay experience and outcomes over a multiplicity of games using an information processor coupled to a non-volatile memory;

changing gameplay capability based on the stored accumulated gameplay experience.

18. The method of claim 17, wherein said information processing step generates a data structure based on videogame or puzzle activity outcomes for representing the accumulation of gameplay experience.

19. The method of claim 18, wherein said data structure associated with each participant determines a level which defines the available special attacks for that participant.

20. An interactive apparatus for an infrared (IR) tag shooting game between a participant and one or more other participants, the improvement comprising:

an information processor coupled to a non-volatile memory and configured so as to accumulate gameplay experience, and retain or recover accumulated gameplay experience of the interactive apparatus when or after not being powered, including gameplay experience from prior games;

the information processor being configured to alter future gameplay of the interactive apparatus responsive to the accumulated gameplay experience.

21. The interactive apparatus of claim 20 further comprised of an IR transmitter and receiver coupled to the information processor, wherein the information processor in the interactive apparatus may communicate with the information processor in other interactive apparatuses through the IR transmitters and receivers in the two interactive apparatuses, whereby some gameplay characteristic of the interactive apparatuses may be altered by the accumulated gameplay experience of the other interactive apparatuses.

22. The interactive apparatus of claim 21 wherein the information processor is responsive to accumulated gameplay experience to alter future gameplay of the interactive apparatus by increasing or decreasing a level of gameplay, each successive level of gameplay representing higher gameplay accomplishments, each successive level of gameplay having associated with it at least one additional gameplay characteristic of the interactive apparatus.

23. The interactive apparatus of claim 22 further comprising a display and an input device, and wherein each level of gameplay has associated with it multiple additional gameplay characteristics of the interactive apparatus from which the participant may select a lesser number of the multiple additional gameplay characteristics to use at that level of gameplay, the selection being made through the use of the display and input device.

24. The interactive apparatus of claim 23 wherein the additional gameplay characteristics comprise damage attacks and chaos attacks, a damage attack causing simulated damage to another interactive apparatus, and a chaos attack causing another interactive apparatus to behave in strange and chaotic ways.

25. The interactive apparatus of claim 23 wherein the multiple additional gameplay characteristics include multiple attacks and multiple defenses from which the participant may select a lesser number to use at that level of gameplay.

26. The interactive apparatus of claim 25 wherein the operating characteristics of the interactive apparatus for future play is shaped by a cumulative selections made as the interactive apparatus advances through the multiple levels.

* * * * *